United States Patent [19]

Mabuchi

[11] Patent Number: 4,572,166

[45] Date of Patent: Feb. 25, 1986

[54] SELF-TRAVELLING VIBRATION GENERATOR

[75] Inventor: Kenichi Mabuchi, Matsudo, Japan

[73] Assignee: Bio Mabuchi Co. Ltd., Japan

[21] Appl. No.: 494,371

[22] Filed: May 13, 1983

[30] Foreign Application Priority Data

May 19, 1982 [JP] Japan ..... 57-84367
May 20, 1982 [JP] Japan ..... 57-85575

[51] Int. Cl.[4] ..... A61H 15/00

[52] U.S. Cl. ..... 128/52; 74/40; 74/89.17; 74/422; 128/57

[58] Field of Search ..... 128/25 R, 25 B, 33–36, 128/31, 39, 41, 44–46, 48, 49, 51, 52, 56, 57, 67; 188/32; 74/89.17, 89.18, 40, 51, 422; 366/111; 272/73, 134, 900; 5/60–65, 108, 109, 423, 449, 463, 433, 462, 464, 469; 269/328, 325, 60, 69; 297/337, 338, 345, 346, 423, 429, 374, 375, 377, 452

[56] References Cited

U.S. PATENT DOCUMENTS

| | | | |
|---|---|---|---|
| 2,884,923 | 5/1959 | Buffalow | 128/57 |
| 3,003,497 | 10/1961 | Nunes | 128/57 |
| 3,238,936 | 3/1966 | Siedentop | 128/57 |
| 3,882,856 | 5/1975 | Heuser | 128/57 |
| 4,412,534 | 11/1983 | Hamabe | 128/57 |

FOREIGN PATENT DOCUMENTS

| | | | |
|---|---|---|---|
| 2108392 | 5/1983 | United Kingdom | 128/57 |

*Primary Examiner*—Clyde I. Coughenour
*Attorney, Agent, or Firm*—McGlew and Tuttle

[57] ABSTRACT

A self-travelling vibration generator having a travelling frame movably supported by parallel rails, a lifting/-lowering frame standing at substantially right angles with respect to the travelling frame, a plurality of eccentric rollers provided off-center with respect to a roller shaft rotatably provided on the lifting/lowering frame; and having such a construction that an induction motor is used for at least either of a motor for travelling the travelling frame or a motor for rotating the roller shaft so as to cause the eccentric rollers to give vibrations to a human body while travelling on the human body.

6 Claims, 7 Drawing Figures

SELF-TRAVELLING VIBRATION GENERATOR

BACKGROUND OF THE INVENTION

1. Field of the Invention

This invention relates generally to a self-travelling vibration generator, and more particularly to a self-travelling vibration generator wherein eccentric rollers give vibration to the abdominal region of a patient lying on his face on a bed, while travelling on the abdominal surface.

2. Description of the Prior Art

Self-travelling vibration generators for giving vibration to the back region of a patient lying on his back on a bed while travelling along the back surface are already known. On the contrary, the present applicant has proposed earlier a self-travelling vibration generator wherein the vibrating element thereof gives vibration to the abdominal region of a patient lying on his face, not on his back, on a bed while travelling along the abdominal surface.

In such a device, however, eccentric rollers as the vibrating element tend to sink into the abdominal surface because the abdominal surface is relatively soft and flexible. It was found that this necessitates a relatively large power for motors for causing the eccentric rollers to travel and vibrate.

SUMMARY OF THE INVENTION

It is an object of this invention to provide a self-travelling vibration generator which gives stable and strong vibration to a human body, particularly the abdominal region thereof, by using an induction motor for at least either of a drive motor for causing eccentric rollers to travel or a drive motor for causing said eccentric rollers to vibrate.

It is another object of this invention to provide a self-travelling vibration generator wherein an induction motor is used for causing said eccentric rollers to travel, and the problem of small starting torque of said induction motor is solved by providing a slide worm in the output transmission mechanism of said induction motor.

It is a further object of this invention to provide a self-travelling vibration generator wherein an induction motor is used for causing said eccentric rollers to vibrate, and the frequency of vibration of said eccentric rollers is changed by changing over the direction of rotation of said induction motor, eyeing at the fact that the vibration of said eccentric rollers is not affected by the direction of rotation of the shaft of said eccentric rollers.

DETAILED DESCRIPTION OF THE INVENTION

Figure 1:
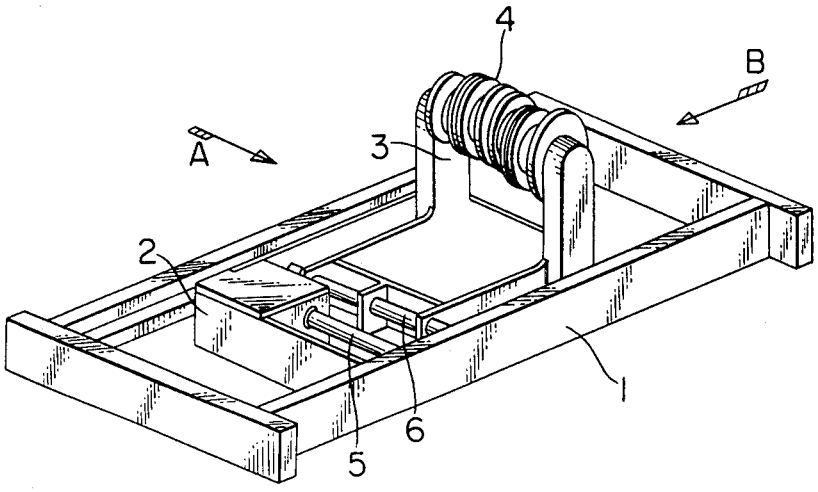
FIG. 1 is a perspective view of essential parts of a self-travelling vibration generator embodying this invention.

In FIG. 1 illustrating a self-travelling vibration generator according to this invention, reference numeral 1 refers to a fixed frame; 2 to a travelling frame; 3 to a lifting/lowering frame; 4 to eccentric rollers; 5 to a travelling shaft; 6 to a lifting/lowering frame center shaft, respectively.

In the embodiment shown in the figure, the lifting/-lowering frame 3 has such a construction that L-shaped members provided at both ends thereof rise at substantially right angles from the travelling frame 2. The lifting/lowering frame 3 is movably supported by the lifting/lowering frame center shaft 6, as will be described later in reference to FIG. 2. With this arrangement, the eccentric rollers 4 provided at the upper end of the lifting/lowering frame 3 are lifted or lowered to set the eccentric rollers 4 at a height suitable for giving vibration to the abdominal region of a patient lying on his face on a bed (not shown in FIG. 1).

The travelling frame 2, with the entire lifting/lowering frame 3 resting thereon, is constructed so as to travel along the fixed frame 1 in the direction shown by arrow B in the figure, or in the opposite direction. With this, the afore-mentioned eccentric rollers 4 travel over the abdominal surface upon actuation as will be described later. Though not clearly shown in FIG. 1, a roller shaft supporting the eccentric rollers 4 is caused to rotate by a vibration generating motor, whereby the eccentric rollers 4 give vibration to the abdominal region, as shwon in FIG. 2 or 4.

In FIGS. 2 through 5, numerals 1, 2, 3, 4, 5 and 6 correspond with like numerals in FIG. 1. As celarly shown in FIG. 3A, the travelling frame 2 is movably supported and guided by rails 7 fixedly fitted to the fixed frame 2 via travelling rollers 8. The travelling frame 2 is equipped with a pinion 10 fixedly fitted to the travelling shaft 5 and engaging with a travelling rack 9 fixedly fitted to the fixed frame 1, as shown in FIG. 3B. As the travelling shaft 5 is caused to rotate, as will be described later, the entire travelling frame 2 travels along the rails 7 via the travelling rollers 8.

Figure 5:
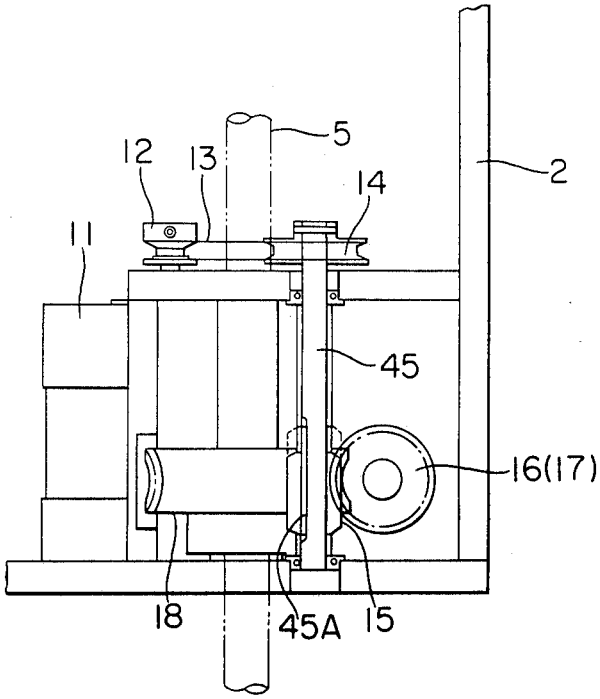
FIG. 5 is a diagram of assistance in explaining, in conjunction with FIG. 2, the state where the travelling frame is driven by the travelling motor.
Figure 2:
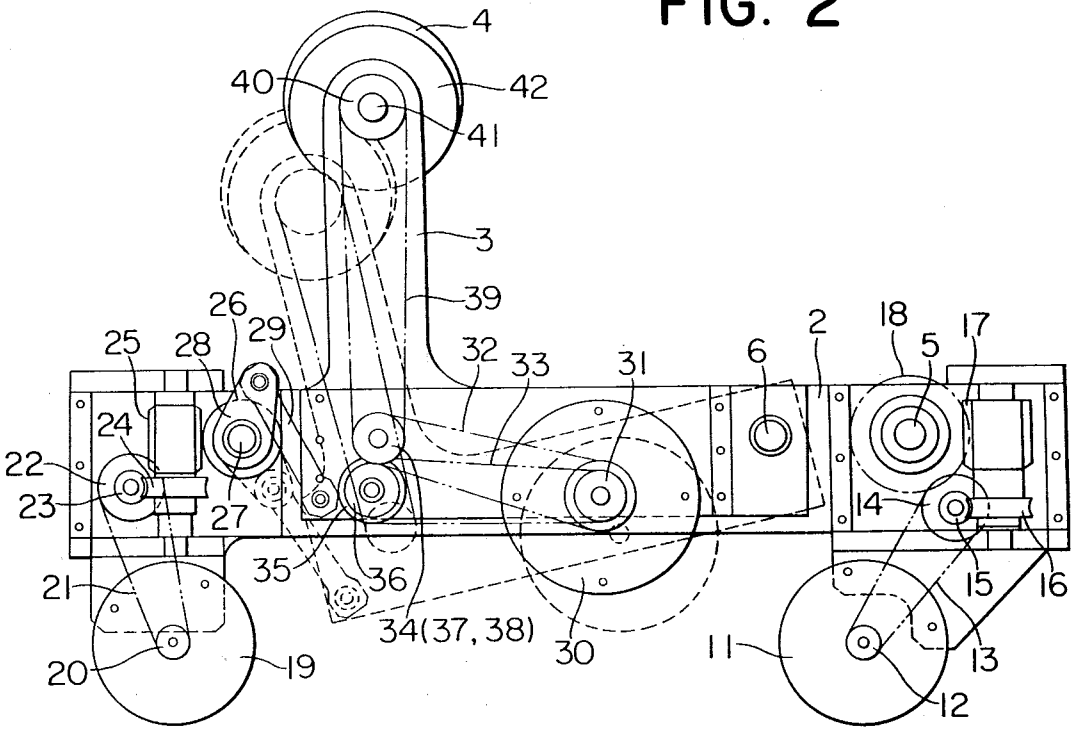
FIG. 2 shows the construction of the essential parts shown in FIG. 1, viewed from the direction shown by arrow A in FIG. 1.

As shown in FIGS. 2 and 5, a travelling motor 11 is provided on the travelling frame 2. Said motor 11 rotates the travelling shaft 5 via a motor pulley 12, a belt 13, a travelling pulley 14, a slide worm 15, a worm wheel 16, a worm 17 and a worm wheel 18, whereby the travelling frame 2 is caused to travel, as described earlier.

As shown at the lower left part of FIG. 2, on the travelling frame 2 provided is a lifting/lowering motor 19 which lifts and lowers an end of the lifting/lowering frame 3 via a lifting/lowering motor pulley 20, a belt 21, a pulley 22, a worm 23, a worm wheel 24, a worm 25, a worm wheel 26, a lifting/lowering shaft 27, a lifting/-lowering arm 28 and a lifting/lowering rod 29, as shown in FIG. 2. That is, the lifting/lowering frame 3 is lifted and lowered around the lifting/lowering frame center shaft 6 so as to adjust the height of the eccentric rollers 4.

Figure 4B:
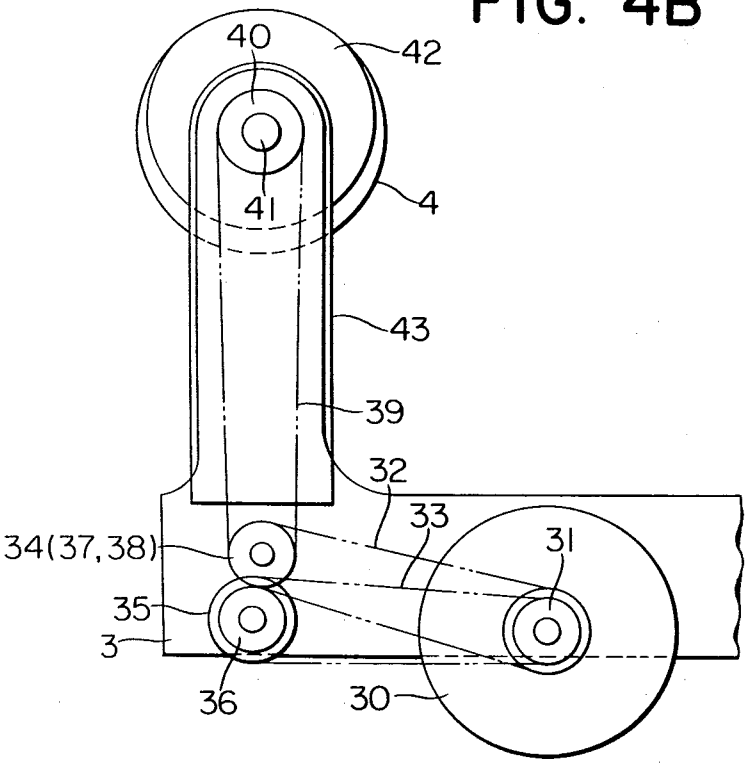
FIG. 4B is a side view, viewed from the direction shown by arrow C in FIG. 4A.

On the lifting/lowering frame 3 a vibration generating motor 30, is provided as shown in FIGS. 2 and 4B.

Figure 4A:
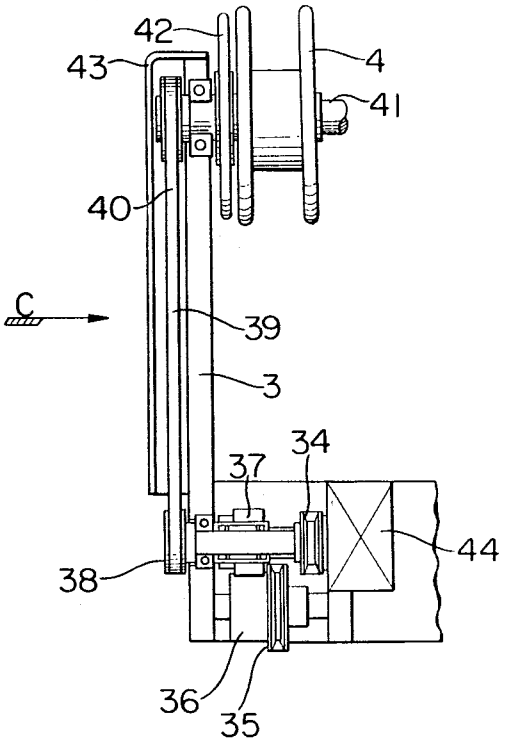
FIG. 4A is a diagram of assistance in explaining the state where the eccentric rollers are driven.

When the vibration generating motor 30 rotates in the normal direction, a one-way clutch 44 shown in FIG. 4A is caused to engage, therby causing a roller shaft 41 to rotate at high speed. This rotation is transmitted via a motor pulley 31, a belt 32, a pulley 34 a pulley 38, a belt 39 and a pulley 40, as is apparent from FIGS. 2, 4A and 4B. When the vibration generating motor 30 rotates in the reverse direction, the one-way clutch 44 shown in FIG. 4A is caused to disengage, causing the roller shaft 41 to rotate at low speed in the reverse direction via the motor pulley 31, the belt 33, the pulley 35, an idle gear 36, an idle gear 37, the pulley 38, the belt 39 and the pulley 40.

Figure 3A:
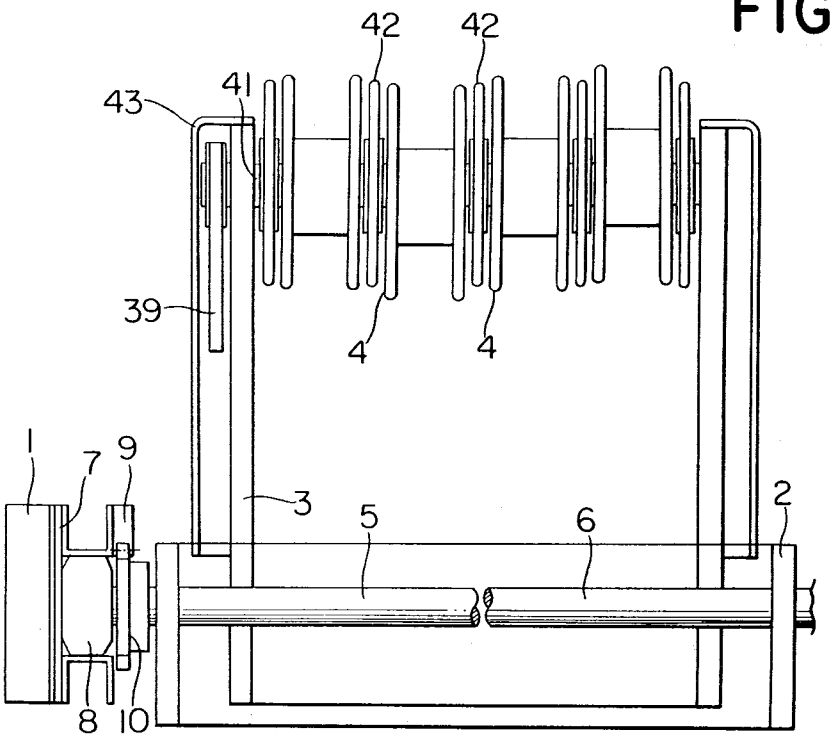
FIG. 3A shows the construction of the essential parts shown in FIG. 1, viewed from the direction shown by arrow B in FIG. 1.
Figure 3B:
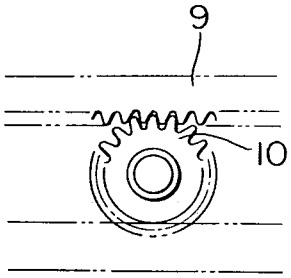
FIG. 3B is an enlarged view of assistance in explaining the state where the travelling frame is caused to move along the travelling rail.

On the roller shaft 41, concentrically provided are a plurality of guide wheels 42 which are adapted to be freely rotatable with respect to the roller shaft 41, as shown in FIG. 3A. Furthermore, a plurality of the eccentric rollers 42 are fixedly fitted to the roller shaft 41, off-center with respect to the roller shaft 41, and adapted to rotate together with the roller shaft 41. As mentioned earlier, as the roller shaft 41 is caused to rotate by the vibration generating motor 30, the eccentric rollers 4 are rotated off-center with respect to the roller shaft 41, giving vibration to the abdominal region. As the travelling frame 2 travels, on the other hand, the guide wheel 42, which is freely rotatable with respect to the roller shaft 41, rotates on the abdominal surface, facilitating the travel of the travelling frame 2.

The self-travelling vibration generator of this invention has such a construction as described in reference to FIGS. 1 through 5. With this construction, the eccentric rollers 4 are caused to give vibration to the abdominal region, for example, by the vibration generating motor 30, the height of the eccentric rollers 4 is set to a desired level by the lifting/lowering motor 19, and the travelling frame 2 is caused to travel over the abdominal surface by the travelling motor 11.

With such a construction as described in reference to the abovementioned embodiment, this invention uses an induction motor capable of producing relatively large output for the travelling motor 11 because the eccentric rollers 4 must be caused to travel over the abdominal surface while depressed by the abdominal surface. Despite such an advantage, however, the induction motor has a shortcoming in terms of operating performances in that the starting torque thereof is relatively lower than the DC motor. This poses a problem with the self-travelling vibration generator which requires a large starting torque to start under a loaded state where the eccentric rollers 4 are depressed by the abdominal region of a patient. The present invention overcomes this problem by providing a slide worm 15 in the intermediate transmission mechanism thereof for transmitting the output of the motor 11 to the travelling shaft 5. That is, the slide worm 15 is connected to the travelling pulley 14 receiving the output of the travelling motor 11 via a shaft 45, as shown in FIG. 5. On the shaft 45 provided is a groove 45A to make the slide worm 15 slidable within a predetermined range. This arrangement permits the slide worm 15 to slide to a predetermined position along the groove 45A provided on the shaft 45 as the output of the motor 11 rotates the shaft 45 having the slide worm 15. Thus, the output of the motor 11, which has already been started, is not transmitted to the worm wheel 16 in mesh with the slide worm 15 so long as the slide worm 15 keeps sliding on the shaft 45. Consequently, the travelling motor 11 is not subjected to a large load from the travelling frame 2 so long as the slide worm 15 keeps sliding on the shaft 45. Once the slide worm 15 has slid up to a predetermined position, the slide worm 15 begins transmission of the output of the travelling motor 11 to the worm wheel 16 in mesh therewith. Thus, the torque generated by the travelling motor 11 becomes sufficiently large to drive the travelling frame 2 during the sliding motion of the slide worm 15. When the travelling frame 2 is driven in the reverse direction, the slide worm 15 is slid in the opposite direction to the abovementioned sliding direction, giving a time lag enough to permit the motor 11 to increase the output thereof in the same way as described above. That is, it becomes easy to start the motor 11 when the travelling frame 2 that has been stopped is to resume travelling.

With the construction of the embodiment described above, this invention uses an induction motor having relatively large output since the eccentric rollers 4 must travel over the abdominal surface while being depressed by the abdominal region, as described above. It is more difficult for the induction motor to freely change the revolution thereof compared to the DC motor, for example. It is desired, however, to change the vibration frequency of the eccentric rollers 4. To this end, this invention uses an induction motor for the vibration generating motor 30, as described in reference to FIGS. 4A and 4B, and has such a construction that the eccentric rollers 4 gives high-frequency vibration to the abdominal region when the motor 30 is rotated in the normal direction, and that when the motor 30 is rotated in the reverse direction the use of the one-way clutch, for example, permits the eccentric rollers 4 to give low-frequency vibration to the abdominal region. This can be achieved based on the fact that the generation of vibration by the eccentric rollers 4 is not affected by the direction of rotation thereof.

Although both the guide wheels 42 and the eccentric rollers 4 of the same diameter are used in the embodiment shown in FIG. 3A, the diameter of the guide wheel 42 and the eccentric rollers 4 on both sides may be made larger than that of the guide wheels 42 and the eccentric rollers 4 in the middle. Furthermore, additional means may be provided to this invention. For example, warm air is blown onto the neighborhood of the eccentric rollers 4 by mounting a heater on the travelling frame 2 and providing a fan driven by the vibration generating motor 30.

As described above, this invention makes it possible for eccentric rollers to give stable and strong vibrating action by using an induction motor for at least either of the travelling motor thereof for travelling the eccentric rollers or the vibration generating motor thereof for giving vibration to the eccentric rollers.

This invention makes it possible to cause a travelling frame having vibrating eccentric rollers to travel by using an induction motor for the travelling motor thereof to make use of the advantage of the induction motor and employing a relatively simple mechanism to make up for the low starting torque of the induction motor.

Furthermore, this invention makes it possible to change the vibration frequency of the eccentric rollers even when an induction motor is used for the vibration generating motor thereof by employing a relatively simple mechanism.

What is claimed is:

1. A self-travelling vibration generator having a travelling frame movably supported on parallel rails, a lifting/lowering frame with end leg portions rising at substantially right angles with respect to said travelling frame, a plurality of eccentric rollers provided off-center with respect to a roller shaft rotatably provided at the upper part of said lifting/lowering frame, and characterized in that an induction motor is used for the motor thereof for travelling said travelling frame, and a slide worm is provided in a mechanism for transmitting the output of said induction motor to said travelling frame to permit the load free rotation of said induction motor at the start of said induction motor.

2. A slef-travelling vibration generator as set forth in claim 1 wherein said lifting/lowering frame has laterally spaced L-shaped members with legs which rise at substantially right angles from said travelling frame, and is supported by said travelling frame in such a manner as to permit said lifting/lowering frame to be lifted and lowered.

3. A self-travelling vibration generator as set forth in claim 1 wherein said eccentric rollers consist of eccentric rollers of larger diameter at both ends and eccentric rollers of smaller diameter at the center.

4. A self-travelling vibration generator as set forth in claim 1 wherein said slide worm is combined with a shaft rotated by said induction motor in such a manner as to permit said slide worm to slide in the axial direction of said shaft, and begins engaging with a worm wheel, which is linked with said travelling frame through a transmission mechanism, from a predetermined location to which said slide worm has been slid along.

5. A self-travelling vibration generator having a travelling frame movably supported on parallel rails, a lifting/lowering frame rising at substantially right angles with respect to said travelling frame, a plurality of eccentric rollers provided off-center with respect to a roller shaft rotatably provided at the upper part of said lifting/lowering frame, and characterized in that an induction motor is used for the motor thereof for rotating said roller shaft; said induction motor being adapted to be reversible; and a revolution changeover mechanism is interposed between the revolution shaft of said induction motor and said roller shaft to change over the speed of said induction motor in accordance with the direction of revolution of said induction motor, whereby the vibration frequency of said eccentric rollers is changed by changing over the direction of revolution of said induction motor.

6. A self-travelling vibration generator as set forth in claim 5 wherein said revolution changeover mechanism includes at least two systems of revolution transmission devices for selectively changing over the connection with said induction motor by means of a one-way clutch.

* * * * *